US006986445B1

(12) United States Patent
Stockman

(10) Patent No.: US 6,986,445 B1
(45) Date of Patent: Jan. 17, 2006

(54) BACKPACK AND CHAIR APPARATUS

(76) Inventor: James A. Stockman, 2 McDuffee Rd., Tuftonboro, NH (US) 03816

( * ) Notice: Subject to any disclaimer, the term of this patent is extended or adjusted under 35 U.S.C. 154(b) by 355 days.

(21) Appl. No.: 09/615,683

(22) Filed: Jul. 14, 2000

(51) Int. Cl.
*A45F 4/02* (2006.01)

(52) U.S. Cl. ..... 224/155; 297/59; 297/129

(58) Field of Classification Search ..... 224/153, 224/155; 292/129, 25, 31, 54, 59
See application file for complete search history.

(56) References Cited

U.S. PATENT DOCUMENTS

| | | | | | |
|---|---|---|---|---|---|
| 1,331,145 | A | * | 2/1920 | Fisher | |
| 1,389,940 | A | * | 9/1921 | Erbeau | |
| 2,766,813 | A | * | 10/1956 | Kay | |
| 3,315,856 | A | * | 4/1967 | Black | 224/155 |
| 4,487,345 | A | | 12/1984 | Pierce et al. | 224/155 |
| 4,720,029 | A | | 1/1988 | Varanakis | 224/155 |
| D338,779 | S | | 8/1993 | Albert | D3/32 |
| 5,289,958 | A | | 3/1994 | Jay | 224/155 |
| 5,303,975 | A | | 4/1994 | Asato | 297/129 |
| 5,381,941 | A | | 1/1995 | Brune | 224/155 |
| 5,409,291 | A | | 4/1995 | Lamb et al. | 297/129 |
| 5,492,255 | A | | 2/1996 | Gansky et al. | 224/153 |
| 5,499,760 | A | | 3/1996 | Pielocik | 224/155 |
| 5,527,088 | A | | 6/1996 | MacLean | 297/129 |
| 5,536,064 | A | | 7/1996 | MacLean | 297/129 |
| 5,538,318 | A | | 7/1996 | MacLean | 297/129 |
| 5,816,463 | A | * | 10/1998 | Echeverri | 224/153 X |
| 5,833,095 | A | * | 11/1998 | Russell et al. | |
| 5,927,575 | A | * | 7/1999 | Gatling | 224/155 X |

FOREIGN PATENT DOCUMENTS

| | | | | |
|---|---|---|---|---|
| DE | 806707 | * | 6/1951 | 297/25 |

* cited by examiner

*Primary Examiner*—Stephen K. Cronin

(57) ABSTRACT

A backpack and chair apparatus with the ability to convert between a balanced backpack and a structurally rigid chair of normal household size. The conversion requires only nominal assembly and effort, does not disrupt the pack load or its accessibility, and requires no tools or separate parts. This advantageously increases the simplicity of pack stowage and the availability of a chair upon demand by those who would otherwise tote a separate chair within or upon a backpack.

13 Claims, 4 Drawing Sheets

BACKPACK AND CHAIR APPARATUS

BACKGROUND OF THE INVENTION

1. Technical Field

The present invention relates to backpacks and chairs, and in particular, to backpack and chair combinations.

2. Related Technology

The popularity of backpacking and peripheral sports is at an all-time high, and there is a tendency for participants to incorporate the comfort of a chair into their experience. Many chairs have been developed to fulfill this demand, most commonly in the form of separate, lightweight and packable designs. However, a separate chair must be carried within or upon a participant's backpack, which complicates the simplicity of pack stowage and the availability of the chair upon demand.

One approach to solving this problem has been through the combination of a backpack and chair into a single unit that can be converted between modes. However, the embodiments of this approach are generally deficient because the backpack is unbalanced on a user's back, the chair is of inadequate rigidity or abnormal dimension, or the conversion process is disruptive to the pack load or its accessibility, or requires excessive assembly in terms of time, effort or the need for tools and separate parts.

Patents in this field include the following, the disclosures of which are hereby incorporated herein by reference: 5,538,318; 5,536,064; 5,527,088; 5,499,760; 5,492,255; 5,409,291; 5,381,941; 5,303,975; 5,289,958; 4,720,029; 4,487,345; and Des. Pat. No. 338,779.

The deficiencies encountered by earlier approaches to the backpack-chair combination have been avoided or overcome by the present invention. The earlier approaches had these shortcomings because they either failed to recognize or were unable to discern the unique combination of elements and interrelationships of the present invention which is briefly outlined in the following Summary, more fully described in the following Detailed Description defined by the Claims that follow.

SUMMARY OF THE INVENTION

A backpack and chair apparatus in accordance with one embodiment of the present invention overcomes or avoids the deficiencies of earlier approaches by using a frame, sub-frame, locking assembly, shoulder straps and storage pack to provide a balanced backpack with the ability to convert into a structurally rigid chair of normal household size. The conversion requires only nominal assembly and effort, does not disrupt the pack load or its accessibility, and requires no tools or separate parts. The resultant backpack and chair apparatus advantageously increases the simplicity of pack stowage and the availability of a chair upon demand by those who would otherwise tote a separate chair within or upon a backpack.

In accordance with one embodiment of the present invention, a backpack and chair apparatus includes a frame, a sub-frame, a locking assembly, a plurality of straps and a storage pack. The pack and straps are attached to the frame to enable the frame and pack to be carried on one's back when loaded with gear. This is the backpack mode of the apparatus. The sub-frame, which is pivotally attached to the frame, can pivot from a position parallel to the frame where it acts as a back support during backpack mode, to a position perpendicular to the frame where it acts as a seat during what is termed the chair mode of the apparatus. The locking assembly, which is pivotally attached to the sub-frame, pivots and unfolds from within the sub-frame during backpack mode, to a position during chair mode that acts as the legs of the chair and a bracing mechanism to lock and secure the chair into position.

Further advantages to the present invention exist, such as the storage pack being removably attached to the frame, and the addition of a cushion that is removably attached to the sub-frame. These and other advantages are further described in the following Detailed Description section and defined in the following claims.

DETAILED DESCRIPTION OF A PREFERRED EMBODIMENT

Figure 1:
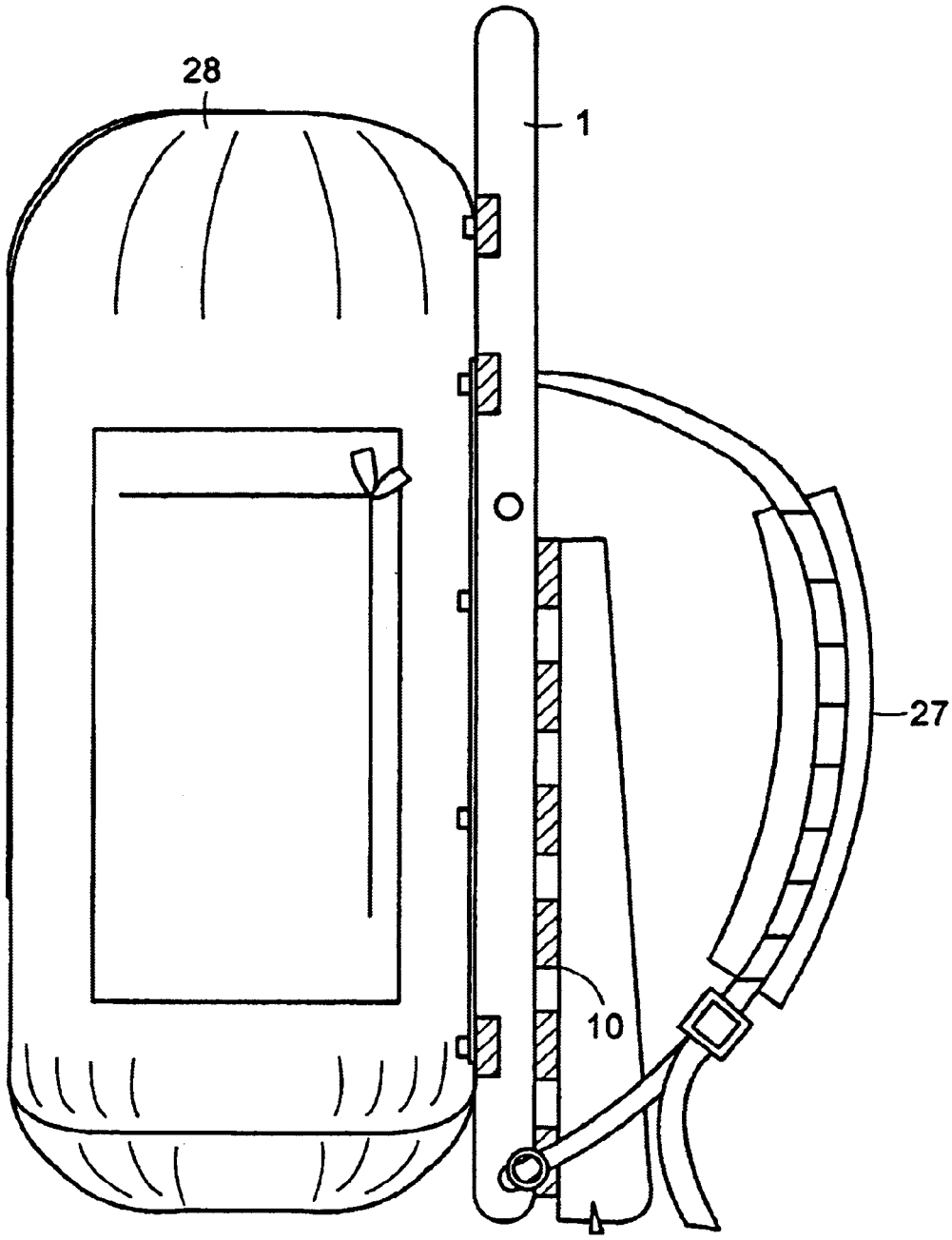
FIG. 1 is a side view of the backpack and chair apparatus in the backpack mode.

FIG. 1 shows the apparatus in backpack mode, with the sub-frame parallel to the frame, the locking assembly in backpack mode enabling position folded within the sub-frame, and the cushion acting as a back support. In this mode, one's arms are placed through the straps until the straps rest on his or her shoulders, thereby enabling the user to carry the apparatus as a standard backpack. The straps are positioned relative to the frame such that the backpack is balanced and the load does not ride too low on the user's back.

Figure 3:
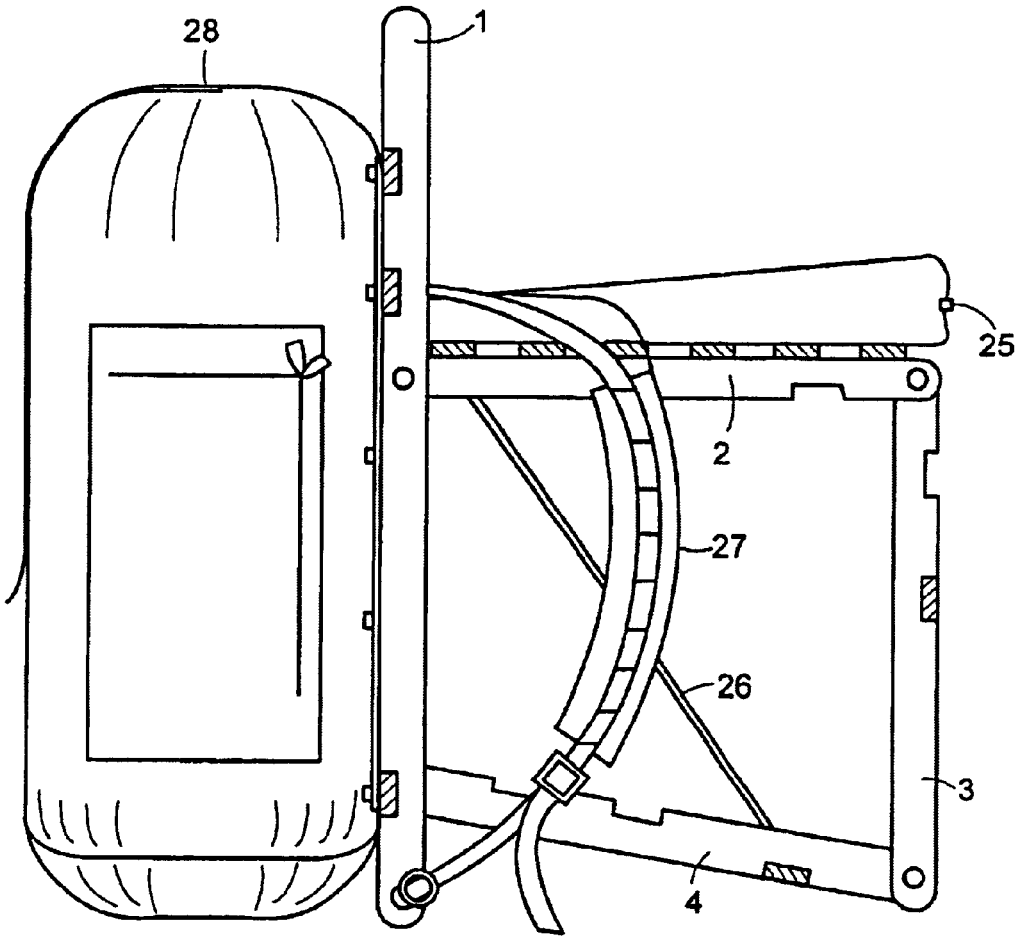
FIG. 3 is a side view of the backpack and chair apparatus in the chair mode.
Figure 4:
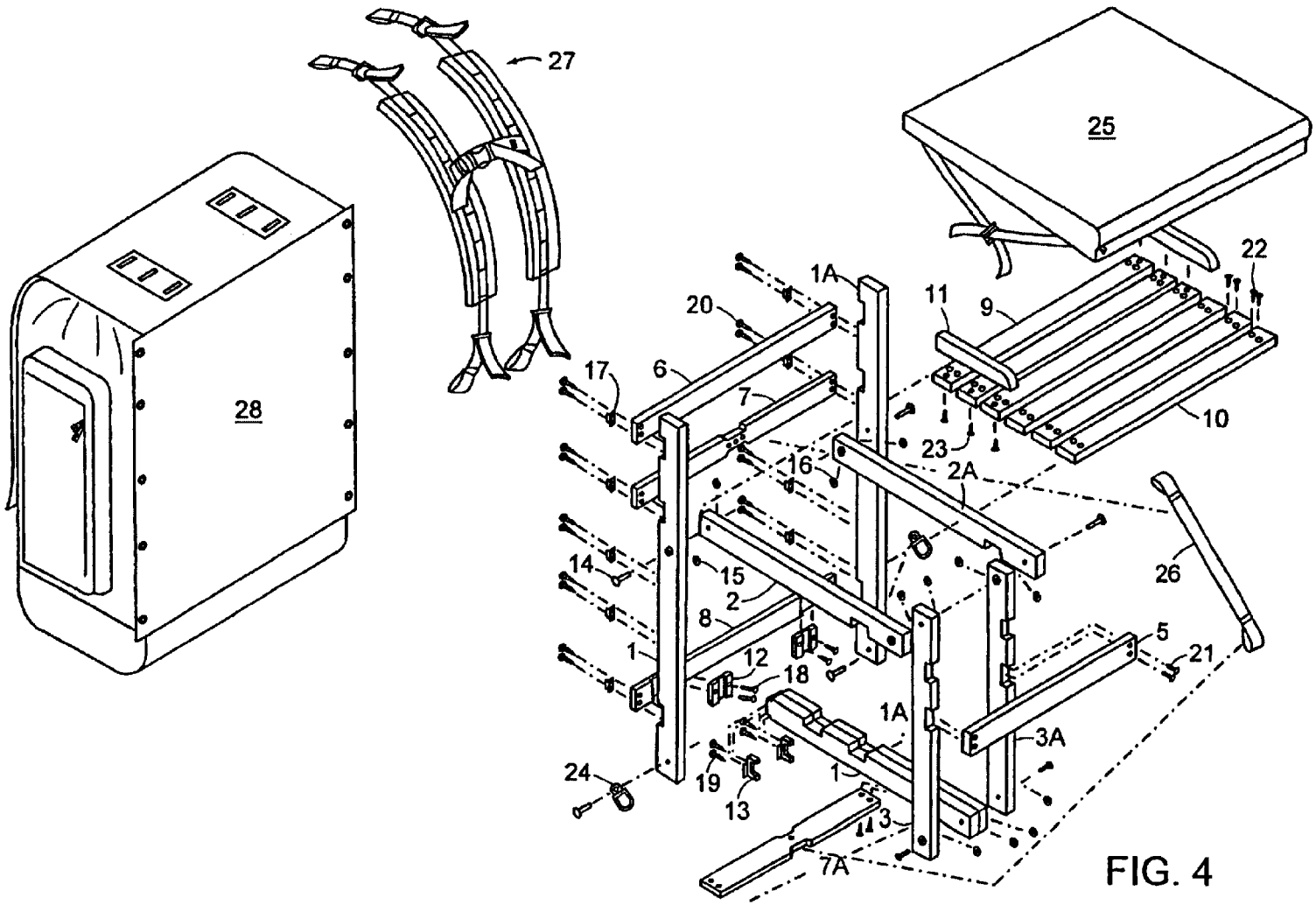
FIG. 4 is a three-dimensional parts breakdown of the backpack and chair apparatus in its preferred embodiment.

FIG. 3 shows the apparatus in chair mode, with the sub-frame perpendicular to the frame. The locking assembly is in chair mode locking position with the jointed swing arms unfolded from the sub-frame and secured to the frame, thereby acting as the legs of the chair and a bracing mechanism to lock and secure the sub-frame to remain in the chair mode when sat on by a person. The cushion is acting as a seat cushion. In this mode, one sits on the cushion and sub-frame with his or her back resting against the upper portion of the frame. The chair is structurally rigid and of normal household size. While in the chair mode, the storage pack and all compartments are easily accessible. Referring to FIG. 4, the combination of slat 8 and 7A aid in preventing the chair-mode apparatus from sinking into soft ground without the need for apparatus feet. As shown in FIG. 4, the following parts are used in this embodiment of the PAC-A-CHAIR:

1 Left Frame Upright
1*a* Right Frame Upright
2 Left Seat Support
2*a* Right Seat Support
3 Left Chair Leg
3*a* Right Chair Leg
4 Left Locking Brace
4*a* Right Locking Brace
5 Chair Leg Brace
6 Top Frame Brace
7 Top Strap Brace
7*a* Bottom Strap Brace
8 Bottom Frame Brace

Figure 2:
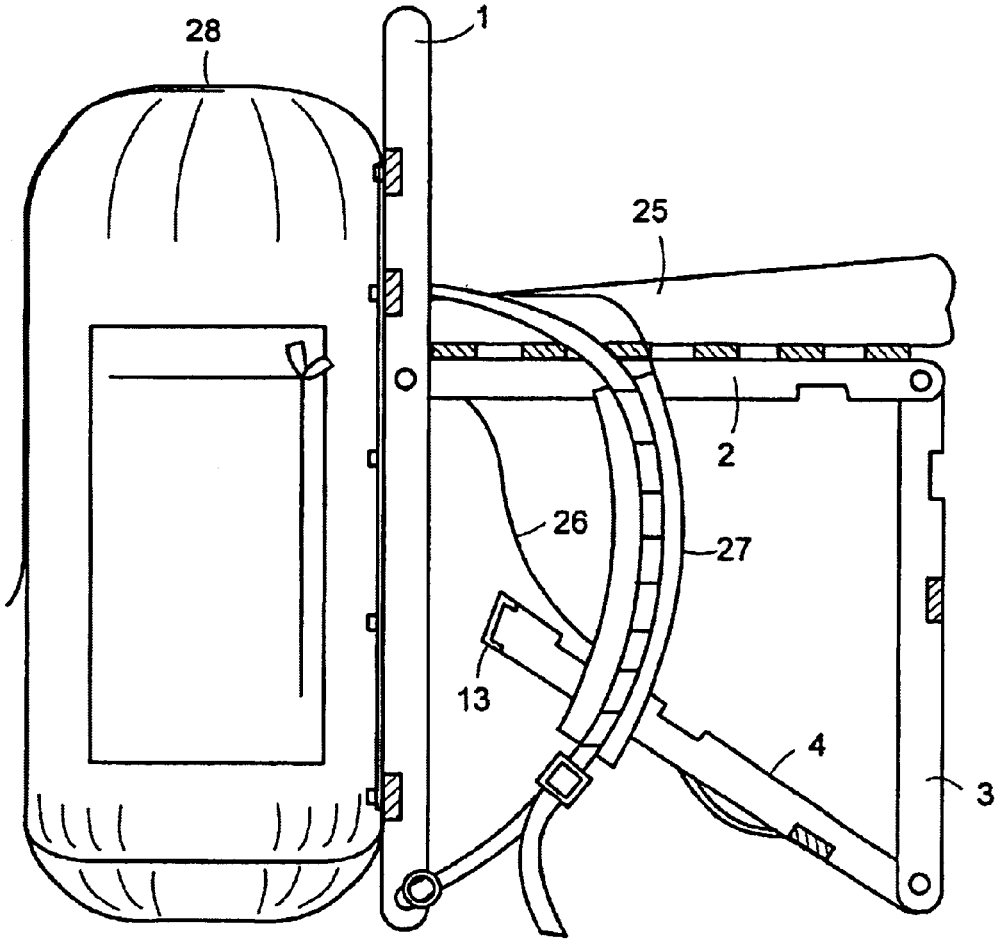
FIG. 2 is a side view of the backpack and chair apparatus being converted from the backpack mode to the chair mode.

9 Inside Seat Slats 3 pc.
10 Outside Seat Slats 3 pc.
11 Seat Brace 2 pc.
12 Bottom Frame Brace Catch
13 Locking Brace Catch
1¼"×5/16 Rivet
15 Spacer washer
16 Rivet Washer
17 Turn Buckle
18 Slide Catch Rivet
19 Slide Catch Screws #6×¾
20 Turn Buckle Screws #6×¾
21 Brass #8×1
22 Seat Slate Screw #8×1
23 Seat Brace Screw #6×¾
24 D Ring
25 Wedge Shape Seat Cushion/Back Support
26 Brace Strap
27 Shoulder Strap
28 Pack Bag FIG. 2 shows the apparatus being converted from backpack mode to chair mode, with the sub-frame fully pivoted from the parallel-to-frame to the perpendicular-to-frame position, and each locking assembly jointed swing arm almost fully unfolded from within the sub-frame to be secured to the frame. Conversion from backpack mode to chair mode, and visa versa, requires nominal assembly, minimal effort, and no tools or separate parts. The conversion begins by simply pivoting the sub-frame from its FIG. 1 to FIG. 2 position. The sub-frame pivoted segment of each jointed swing arm is then fully unfolded to the perpendicular-to-sub-frame position, and the free-end segment of each jointed swing arm is unfolded and attached to the frame via its respective slide catch. Reversing this procedure performs conversion from chair mode to backpack mode, where referring to FIG. 4, the upper set of grooves in slats 3, 3A, 4 and 4A are formed to mate with slat 8 when the apparatus is in the backpack mode.

Referring in greater detail to FIGS. 1 through 3, a backpack and chair apparatus in accordance with one embodiment of the present invention uses a frame, sub-frame, locking assembly, shoulder straps, storage pack and cushion to provide a backpack with the ability to convert into a chair. Each component is described in turn below. The preferred embodiment of the present invention is constructed as shown in further detail in FIG. 4. Referring to FIG. 4, the frame, sub-frame, and locking assembly are preferably made from formed slats of white ash wood, but any sufficiently rigid material of construction is appropriate, such as aluminum tubing or molded plastic. Similarly, although preferable methods of fastening are described, such as screws, rivets and nylon straps, any functional method of fastening is sufficient, The frame acts as the main support of the apparatus, and is created by forming slats 6, 7, and 8 as shown with drilled holes, and connecting them to slats 1 and 1A as shown with turn buckles 17 and turn buckle screws 20. Slats 1 and 1A are designed to extend slightly beyond slat 6 to enable items to be hung or tied.

The sub-frame acts as a back support when in the back pack mode and as a seat when in the chair mode. It is created by forming and drilling slats 2, 2A, 9, 10 and 11, riveting slats 2 and 2A to 1 and 1A as shown with rivets 14, spacer washers 15 and rivet washers 16 as shown, and screwing slats 9 and 10 to 2 and 2A with seat slat screws 22, and 9 to 11 with seat brace screws 23 as shown. The grooves in slats 2 and 2A are formed to mate with slat 8 when the apparatus is in the backpack mode.

The locking assembly, when in chair mode locking position, acts as the legs of the chair and a bracing mechanism to lock and secure the sub-frame to remain in the chair mode when sat on by a person. When in the backpack mode, the locking assembly folds into the sub-frame and out of the way in what is termed the backpack mode enabling position. The locking assembly is constructed by first forming and drilling slats 3, 3A, 4, 4A, 5 and 7A as shown. Two jointed swing arms are then formed from slats 3 and 4, and slats 3A and 4A, each joined by rivet as shown. The slat-3 end of each jointed swing arm is riveted to the end of the sub-frame, slats 2 and 2A as shown. Slat 5 is screwed with brass screws 21 to the mid-section groove of slats 3 and 3A as shown, and slat 7A is screwed to the mid-section grove of slats 4 and 4A as shown. Brace strap 26, which is made of lightweight nylon with end-loops, is inserted and fastened onto the mid-section grooves of slats 7 and 7A as shown. This prevents the chair/sub-frame from pivoting back too far, while the two seat braces 11 prevent the chair/sub-frame from pivoting too far forward. Brace locking catches 13 are screwed with slide catch screws 19 onto the ends of each jointed swing arm, slats 4 and 4A. The respective mates of each Brace Locking Catch, namely, Frame Locking Catches 12, are riveted with slide catch rivets 18 onto the respective grooves of slat 8.

Shoulder straps 27 are attached to the frame with rivets to slat 7 and have snaps that attach to D Rings 24 which are riveted to the bottom of slats 1 and 1A. Shoulder straps 27 include an adjustable sternum strap as shown, and an adjustable waist strap is provided which attaches to the bottom of slats 1 and 1A.

Storage Pack 28 is constructed of heavy density fabric, although any material of reasonable weight and function is sufficient. The Storage Pack is removably attached to the frame via turn buckles 17 as shown, thereby enabling the user to remove the pack for cleaning or to use the chair separately.

Back Support/Seat Cushion 25 is wedge shaped and constructed of foam rubber with waterproof fabric covering, and is removably connected to the sub-frame as shown via a lightweight nylon strap with plastic snaps. There is a zipper provided to allow removal of the foam cushion for washing purposes.

FIG. 4 shows the exploded parts used to build a preferred embodiment of the present invention which has been given the trademark "PAC-A-CHAIR. As shown therein, the following parts are combined to create this unique article of manufacture:

left frame upright (1) and right frame upright (1*a*);
left seat support (2) and right seat support (2*a*);
left chair leg (3) and right chair leg (3*a*);
left locking brace (4) and right locking brace (4*a*);
chair leg brace (5);
top frame brace (6);
top strap brace (7) and bottom strap brace (7*a*);
bottom frame brace (8);
inside seat slats—three pieces (9);
outside seat slats—three pieces (10);
seat brace—two pieces (1 1);
bottom frame brace catch (12);
locking brace catch (13);
plurality of rivets—1.25"×5/16" (14);
plurality of spacer washers (15);
plurality of rivet washers (16);

turn buckles (17);

side catch rivets (18);

side catch screws—#6×¾ (19);

turn buckle screws—#6×¾ (20);

brass screws—#8×1 (21);

seat slat screws—#8×1 (22);

seat brace screws—#6×¾ (23);

D rings (24);

seat cushion/back support, preferably wedge shaped (25);

brace strap (26);

shoulder straps (27); and pack bag (28).

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that the structures and methods within the scope of these claims and their equivalents be covered thereby.

What is claimed is:

1. A backpack and chair apparatus, comprising:

a storage pack;

a frame attached to said storage pack providing rigid structure and back support;

a plurality of straps attached to said frame enabling a person to carry the said frame and said storage pack on one's back in a backpack mode;

a sub-frame pivotally attached to said frame and capable of being pivoted from the backpack mode, wherein the sub-frame is positioned parallel to the frame, to a chair mode, wherein the sub-frame is positioned perpendicular to the frame, thereby enabling a person to sit on the apparatus as a chair, a locking assembly pivotally attached to said sub-frame and capable of being pivoted from a backpack mode enabling position to a chair mode locking position to lock and secure the sub-frame when in the chair mode so that the apparatus remains in the chair mode when sat on by a person;

a cushion attached to the sub-frame such that it acts as a back support when the apparatus is in the backpack mode and a seat cushion when the apparatus in the chair mode.

2. The backpack and chair apparatus of claim 1, wherein the sub-frame, when in chair mode, enables a person to sit on the apparatus as a chair of normal household stability and size.

3. The backpack and chair apparatus of claim 1, wherein said straps are attached to the frame at a position that facilitates a balanced pack load that does not ride uncomfortably low on a user's back when in the backpack mode.

4. The backpack and chair apparatus of claim 1, wherein the storage pack and frame are removably attached.

5. The backpack and chair apparatus of claim 1, wherein the cushion is removably attached to the sub-frame.

6. The backpack and chair apparatus of claim 1, wherein said locking assembly comprises a jointed swing arm pivotally attached at one end to the sub-frame and removably attachable at the other end to the frame, such that one segment of the jointed swing arm acts as a chair leg to the sub-frame when in the chair mode.

7. The backpack and chair apparatus of claim 6, wherein conversion of the sub-frame between backpack mode and chair mode, and correspondingly of the locking assembly between the backpack enabling position and the chair locking position, requires no tools of assembly and is performed with nominal effort.

8. The backpack and chair apparatus of claim 6 wherein the locking assembly further comprises a male locking brace and a female brace catch that interconnect to the locking assembly.

9. A backpack and chair apparatus, comprising:

a storage pack;

a frame attached to said storage pack providing rigid structure and back support;

a plurality of straps attached to said frame enabling a person to carry the said frame and said storage pack on one's back in a backpack mode, wherein said straps are attached to the frame at a position that facilitates a balanced pack load that does not ride uncomfortably low on a user's back when in the backpack mode;

a sub-frame pivotally attached to said frame and capable of being pivoted from the backpack mode, wherein the sub-frame is positioned parallel to the frame, to a chair mode, wherein the sub-frame is positioned perpendicular to the frame, thereby enabling a person to sit on the apparatus as a chair of normal household stability and size;

a locking assembly pivotally attached to said sub-frame and capable of being pivoted from a backpack mode enabling position to a chair mode locking position to lock and secure the sub-frame when in the chair mode so that the apparatus remains in the chair mode when sat on by a person, wherein said locking assembly comprises a plurality of jointed swing arms pivotally attached at one end to the sub-frame and removably attachable at the other end to the frame, such that one segment of each jointed swing arm acts as a chair leg to the sub-frame when in the chair mode;

wherein conversion of the sub-frame between backpack mode and chair mode, and correspondingly of the locking assembly between the backpack enabling position and the chair locking position, requires no tools of assembly and is performed with nominal effort;

a cushion attached to the sub-frame such that it acts as a back support when the apparatus is in the backpack mode and a seat cushion when tie apparatus is in the chair mode.

10. The backpack and chair apparatus of claim 9, wherein the locking assembly comprises a plurality of the said jointed swing arm.

11. The backpack and chair apparatus of claim 9, wherein the storage pack and frame are removably attached.

12. The backpack and chair apparatus of claim 9, wherein the cushion is removably attached to the sub-frame.

13. The backpack and chair apparatus of claim 12, wherein the cushion further includes a zipper for ease of removal.

* * * * *